United States Patent [19]

Sepke

[11] 4,392,271

[45] Jul. 12, 1983

[54] ELECTRIC VACUUM CLEANER WITH WINDOW FOR VIEWING BELT

[75] Inventor: Arnold L. Sepke, Lake Bloomington, Ill.

[73] Assignee: National Union Electric Corporation, Bloomington, Ill.

[21] Appl. No.: 303,715

[22] Filed: Sep. 21, 1981

[51] Int. Cl.[3] ..... A47L 9/00

[52] U.S. Cl. ..... 15/339; 15/391

[58] Field of Search ..... 15/339, 391

[56] References Cited

U.S. PATENT DOCUMENTS 1,347,166 7/1920 Kirby ..... 15/337

4,068,341 1/1978 Scott et al. ..... 15/339

*Primary Examiner*—Chris K. Moore

*Attorney, Agent, or Firm*—Alfred E. Miller

[57] ABSTRACT

An electric vacuum cleaner has a generally opaque housing enclosing a bruch roller rotatable about a horizontal axis, a motor, and a belt or the like extending from the motor to a pulley on or affixed to the brush roller, for driving the brush roller. A transparent window is provided in the top of the housing and aligned with the belt, and highly contrasting markings are provided on the belt, thereby to enable an operator to determine, viewing the belt through the window, the moving condition of the belt.

8 Claims, 6 Drawing Figures

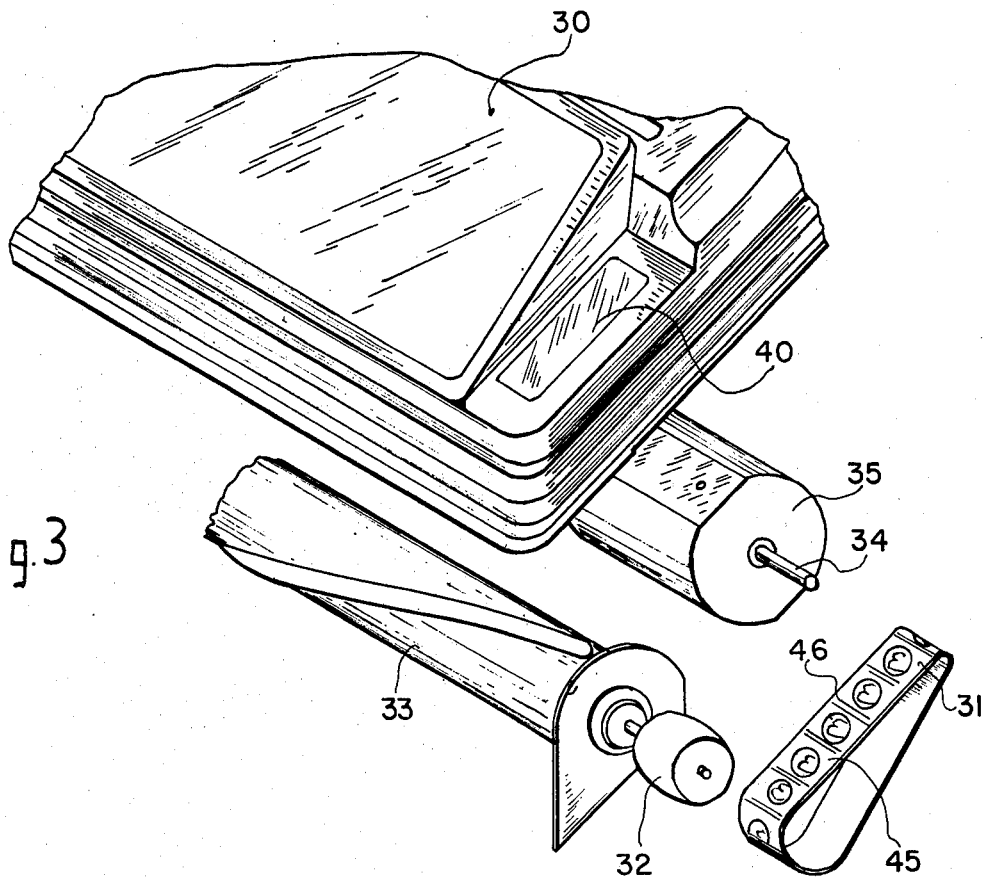
Fig. 3
Fig. 4
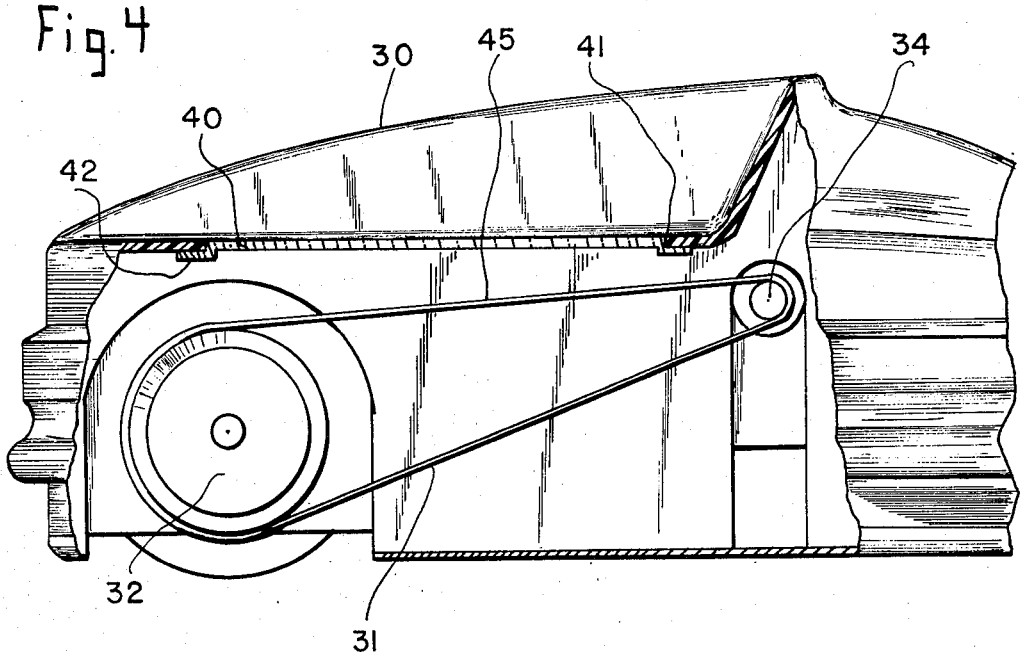

ELECTRIC VACUUM CLEANER WITH WINDOW FOR VIEWING BELT

This invention relates to vacuum cleaners, and is particularly directed to a vacuum cleaner of the type having a housing positionable adjacent a surface to be cleaned, and enclosing a beater bar or roll, a motor drive for the roll, and a drive belt extending between the motor and beater bar for rotating the latter.

In vacuum cleaners of the above type, which may be of a conventional upright type or of the power drive type, it is known that various malfunctions can occur. For example, the beater brush may stall due to entangling with fibers or the like, the belt may be break, or the motor may fail to operate. The operator generally becomes aware of such malfunctioning only by indirect response. Thus, there may be a different sound of operation, the machine may not "act" as it does under normal operation, or it may just not seem to pick up the dirt it should.

In ascertaining the difficulty, the operator must invariably turn the machine upside down, to inspect the brush hole for blockage. If this is not the fault, then a cover must generally be removed beneath the housing, in order to expose the belt, thereby to enable inspection of blockage or breaking of the belt.

The present invention is directed to overcoming the above disadvantages, by enabling means for the operator to directly observe the occurrence of certain malfunctions of the machine, and to be able to more clearly and correctly diagnose problems, even before they occur.

Briefly stated, in accordance with the invention, this objective is achieved by providing a window in the housing, enabling the operator to view at least a part of the belt. Further, the belt is preferably marked distinctively, such that the operator can readily distinguish motion of the belt, so as preferably to ascertain speed and direction thereof. The markings may also be subject to wear, such that the operator will be able to ascertain the age, or the period of use, of the belt, thereby to suggest preventive maintenance of the machine.

In order that the invention will be more clearly understood, it will now be disclosed in greater detail with reference to the accompanying drawings, wherein:

FIG. 3 is an exploded view of the elements of the housing of a vacuum cleaner in accordance with another embodiment of the invention;

FIG. 4 is an enlarged partially cross sectional view of a portion of the vacuum cleaner of FIG. 3;

Figure 1:
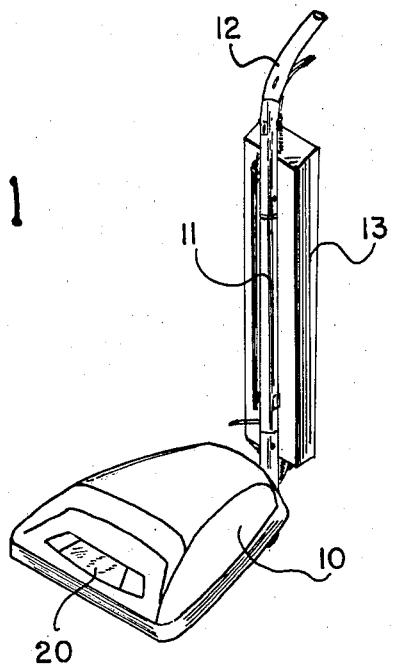
FIG. 1 is a simplified perspective view of an upright vacuum cleaner in accordance with the invention.
Figure 2:
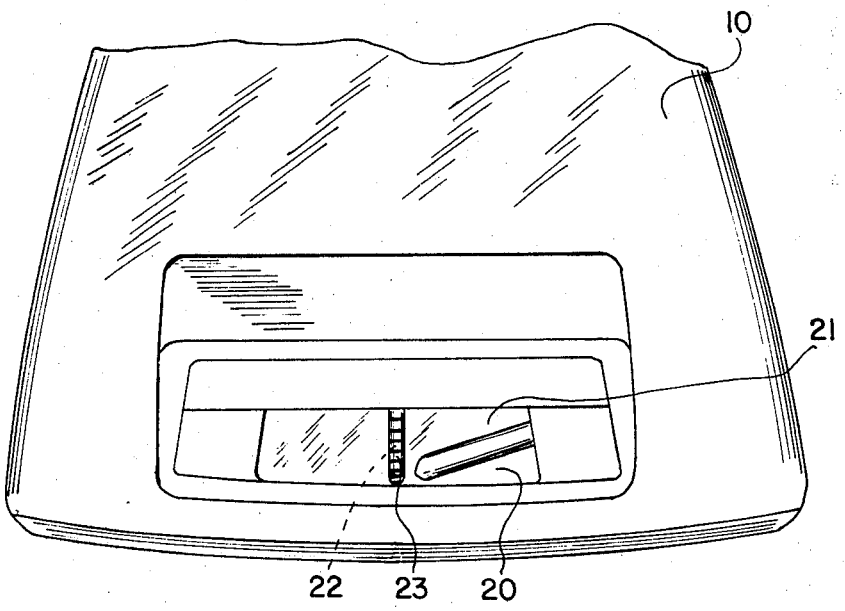
FIG. 2 is an enlarged top view of a portion of the housing of the vacuum cleaner of FIG. 1.
Figure 5:
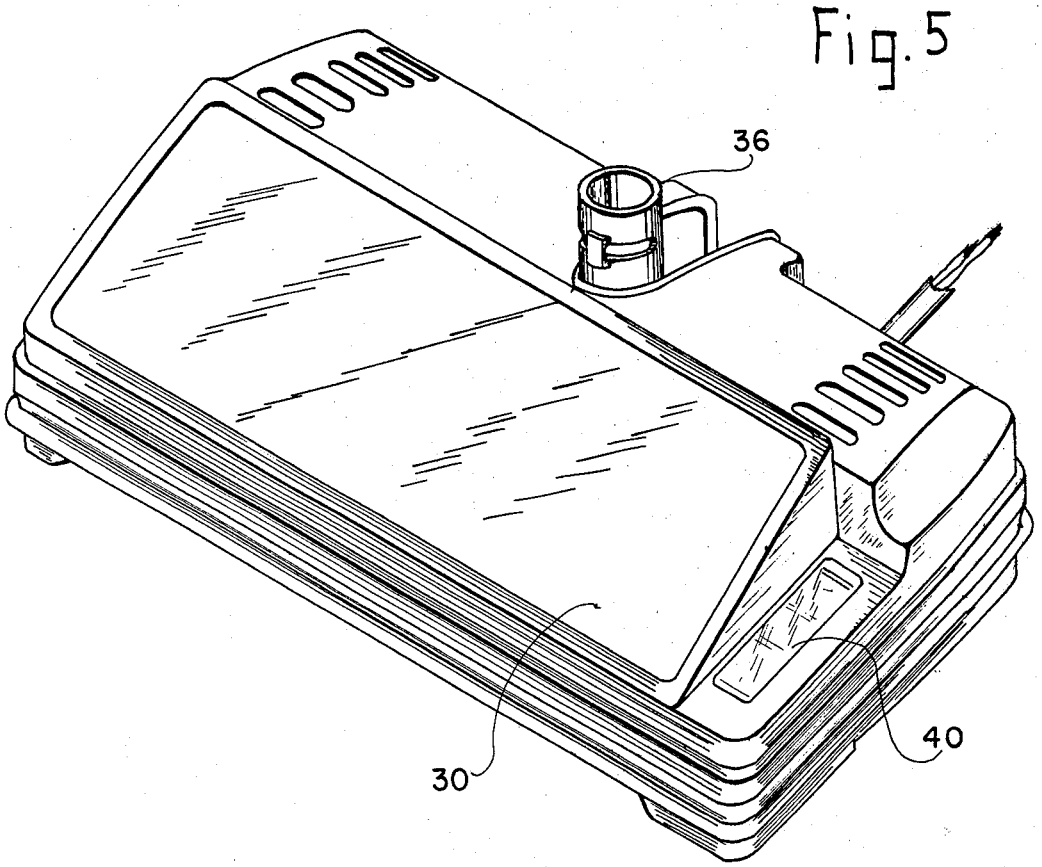
FIG. 5 is a perspective view of the housing of the vacuum cleaner of FIG. 3.
Figure 6:
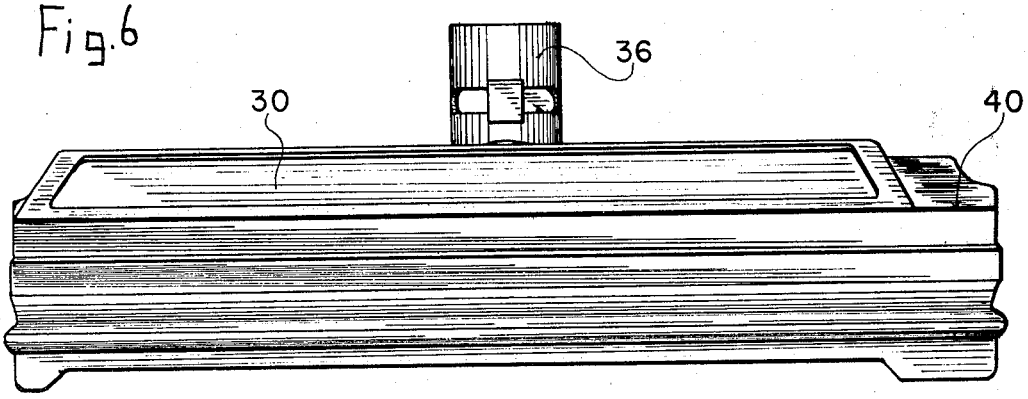
FIG. 6 is a front view of the housing of the vacuum cleaner of FIG. 3.

Referring now to the drawings, and more in particular to FIGS. 1 and 2, therein is illustrated one embodiment of an electric vacuum cleaner in accordance with the invention. FIG. 1 illustrates a vacuum cleaner having a housing 10 adapted to be pushed or pulled along a carpet by means of a wand 11 hinged at its bottom, to the housing 10, the wand 11 having an upper handle 12 for control by the operator. The filter bag assembly 13 is mounted on the wand 11.

Thus far, the features of the vacuum cleaner of FIG. 1 are conventional.

As seen in FIGS. 1 and 2, the housing has a transparent window 20 at a central location thereof above the brush roller 21. In the arrangement of FIGS. 1 and 2, the belt 22 for rotating the brush roller engages a pulley or annular recess generally in the center of the brush roller 21, and extending therefrom rearwardly to a drive motor (not seen in FIGS. 1 and 2). The mechanical configuration of the arrangement of FIGS. 1 and 2 is hence conventional, except for the provision of the transparent window 21. The window 20 enables the user of the machine to readily see the belt 22. In order to enhance this ability, the belt is preferably provided with distinctive markings 23. Although the markings are indicated in FIG. 2 to be in the form of bars, it is evident that any markings on the belt that are readily visible may be employed, if such markings present fairly different appearances when moving and when stopped.

By providing the window in the housing, the operator of the vacuum machine can readily determine a number of conditions in the machine. When the machine is operating properly, and the belt is properly turning the brush roll, this will be readily visible through the window. If the belt is not moving, for example, due to jamming of the brush roller, or malfunction of the motor, this will be readily apparent to the operator since the markings on the belt will stand still. If the belt is broken, of course, this will also be readily apparent to the operator. In addition, slow or erratic movement of the belt may be observed. For example, a stretched belt may move slower than usual, and this condition can now be detected.

A further embodiment of the invention is illustrated in FIGS. 3, 4, 5 and 6. These figures depict only the housing 30 of a vacuum cleaner of the type wherein the belt 31 is mounted to engage a pulley 32 at the end of the brush roller 33. In this arrangement, the other end of the pulley 31 may merely engage the shaft 34 of the drive motor 35. The housing 30 has a suitable conventional hinged coupling 36 for receiving the wand or the like.

Thus far, the components of the vacuum cleaner of FIGS. 3–6 is conventional.

In accordance with the invention, a transparent window 40 is provided in the housing immediately above the belt 31, preferably such that the belt may be visible from above substantially throughout its length. As illustrated in FIG. 4, the housing 30 may be of a plastic material, and have an aperture 41. The aperture may, for example, be generally rectangular. The transparent window 40 may comprise a transparent plastic sheet having a rectangular portion shaped to fit within the aperture 41, the sheet having a flanged outer surface 42 adapted to engage and be affixed to the underside of the housing adjacent the aperture. The window may be affixed by any conventional technique, preferably being mechanically snapped in place and retained therein by projections of the part.

As in the arrangement of FIGS. 1 and 2, the outer surface 45 of the belt is provided with distinctive markings 46. For example, the belt 31 is generally of a dark material, and the markings 46 are hence preferably light colored, such as white. The markings are such that, in the longitudinal direction of the belt, alternate regions of the markings and the belt will be visible, so that movement of the belt is readily detectable.

In other words, the belt is decorated with highly contrasting visual markings to enable its drive condition to be readily visible.

While the invention has been disclosed and described with reference to a limited number of embodiments, it will be apparent that variations and modifications may be made therein. Thus, the belt itself may have a round cross section, as in FIGS. 1 and 2, a flat cross section as in FIGS. 3–6, or any other conventional cross section. It is consequently intended in the following claims to cover each such variation and modification as falls within the true spirit and scope of the invention.

What is claimed is:

1. In a vacuum cleaner having a housing enclosing at least upwardly a beater brush rotatable about a horizontal axis, a motor, and a belt transmitting rotary motion from said motor to said beater brush; the improvement wherein said housing is opaque for the greater part thereof, and has a transparent window fixedly mounted therein to enable a portion of said belt to be viewed from externally of said housing, said belt having distinctive markings thereon, whereby its speed of movement or lack of movement, and regularity of movement, can be observed through said window.

2. The vacuum cleaner of claim 1 wherein said motor is an electric motor having a horizontal axis, and said belt is positioned to drive the end of said beater brush.

3. The vacuum cleaner of claim 2 wherein said window is positioned inside the housing above at least a portion of said belt.

4. The vacuum cleaner of claim 1 wherein said motor is an electric motor having a horizontal axis parallel to the axis of said beater brush, said belt being positioned to drive an end of said beater brush, said housing having a substantially horizontal portion above said belt, said window being mounted in said horizontal portion and extending therealong to enable viewing of a substantial portion of said belt.

5. The vacuum cleaner of claim 4 wherein said horizontal portion of said housing has a rectangular aperture, said window comprising a transparent plastic sheet having a rectangular portion fit within said aperture.

6. The vacuum cleaner of claim 5 wherein said sheet has a flanged edge surface engaging and affixed to the underside of said horizontal portion of said housing.

7. The vacuum cleaner of claim 4 wherein said distinctive markings are provided in alternate regions of said belt.

8. The vacuum cleaner of claim 1 wherein said belt engages said beater brush centrally, said housing having a substantially horizontal portion above the central portion of said beater brush, said window being fixedly mounted in said horizontal portion of said housing.

* * * * *